United States Patent [19]

Chapman

[11] Patent Number: 4,756,102

[45] Date of Patent: Jul. 12, 1988

[54] RESILIENTLY MOUNTABLE SUPPORT STRUCTURE WITH WEAR RESISTANT CONTACTING SURFACE

[76] Inventor: Larry D. Chapman, P.O. Box 475, Woonsocket, S. Dak. 57385

[21] Appl. No.: 19,747

[22] Filed: Feb. 27, 1987

Related U.S. Application Data

[62] Division of Ser. No. 782,401, Oct. 1, 1985, abandoned.

[51] Int. Cl.[4] ..... E01H 5/06

[52] U.S. Cl. ..... 37/270; 172/719; 280/28

[58] Field of Search ..... 37/232, 270, 271; 172/387, 392, 393, 719, 764; 180/182, 183; 280/22, 28

[56] References Cited

U.S. PATENT DOCUMENTS

| | | | |
|---|---|---|---|
| 268,981 | 11/1882 | Johnson | 280/28 |
| 450,766 | 2/1885 | Reinhardt | 280/28 |
| 1,904,201 | 4/1933 | Chapman | 37/270 |
| 2,202,309 | 12/1938 | Campbell | 280/28 |
| 2,611,979 | 9/1952 | Weller | 280/28 |
| 3,732,939 | 5/1973 | Samson | 280/28 |
| 3,739,458 | 6/1973 | Reedy et al. | 280/28 |
| 3,850,440 | 11/1974 | Reedy et al. | 280/28 |
| 4,052,802 | 10/1977 | Moen et al. | 37/141 R |
| 4,086,966 | 5/1978 | Lanz et al. | 172/764 |
| 4,129,952 | 12/1978 | Olson | 37/141 R |
| 4,141,160 | 2/1979 | Olson | 172/719 |
| 4,346,528 | 8/1982 | Shwayder | 37/270 |
| 4,364,447 | 12/1982 | Yoshida | 180/182 |
| 4,450,635 | 5/1984 | Shwayder | 37/271 |

FOREIGN PATENT DOCUMENTS

| | | | |
|---|---|---|---|
| 960035 | 12/1974 | Canada | 37/270 |
| 3316270 | 3/1984 | Fed. Rep. of Germany | 37/232 |
| 3442032 | 5/1986 | Fed. Rep. of Germany | 280/28 |
| 97802 | 9/1977 | German Democratic Rep. | 280/28 |
| 143802 | 10/1980 | German Democratic Rep. | . |
| 8204375 | 12/1982 | PCT Int'l Appl. | 172/719 |

OTHER PUBLICATIONS

Advertisement, Carbide Products, Ltd., Inc., Carbide Armored Support Shoes

Advertisement, Carbide Products, Ltd., Drag Shoes.

Advertisement, Rennametal, Snowplow Shoes.

Advertisement, The Schwayder Company, Surfalite Tungsten Carbide Wearpads.

Advertisement, Kenco Engineering, Inc., Kenco Tungsten Carbide Inserted Drag Shoes.

Advertisement, Kenco-Engineering, Inc. Snowplow Shoes.

Advertisement, Paper, Calmenson & Co., Pacal Carbide-Insert Snow Plow Blades.

*Primary Examiner*—Eugene H. Eickholt

*Attorney, Agent, or Firm*—Robert E. Harris

[57] ABSTRACT

A vehicle mounted ancillary support equipment such as a support runner, foot or shoe for use with street sweepers, snow plows, snow blowers and the like is disclosed. The support runner includes a ground contacting portion, for support of brushes, blades, scoops and the like having wear resistant metal inserts compression mounted in cavities through the ground contacting portion of the runner, and a flexible mounting portion for maintaining the runner on the vehicle. The support runner is particularly adapted for longer and more even wear of the ground engaging surface of the runner while supporting the wear resistant inserts in such a way as to reduce the likelihood of fracturing and chipping.

12 Claims, 2 Drawing Sheets

AA

RESILIENTLY MOUNTABLE SUPPORT STRUCTURE WITH WEAR RESISTANT CONTACTING SURFACE

RELATED INVENTION

This application is a division of U.S. application Ser. No. 06/782,401, filed Oct. 1, 1985, and now abandoned, entitled SUPPORT STRUCTURE WITH WEAR RESISTANT CONTACTING SURFACE.

FIELD OF THE INVENTION

This invention relates to an article for maintaining the positioning of a utilization structure relative to a surface during passage of said structure over said surface and, more particularly, relates to drag shoes for use with street sweepers, snow plows, snow blowers and the like.

BACKGOUND OF THE INVENTION

Excessive and uneven wear of the support runners used with street sweepers, snow plows, snow blowers and other such vehicles is a costly and time consuming maintenance problem, and many such support runners having means to resist such wear have heretofore been suggested and/or utilized. While such devices have been suggested and/or utilized they have met with only limited success, have not been adapted so that the wear resisting means remain firmly affixed to the support runner, have exposed the wear resistant portions of such support runners to premature exhaustion, fracturing and chipping, have employed vehicle mounting mechanisms for such support runners which tend to cause disfigurement of vehicle parts while the vehicle is in use, and/or have been unduly expensive.

SUMMARY OF THE INVENTION

This invention provides an improved support runner for use with street sweepers, snow plows, snow blowers and the like which retards and evens wear on the ground engaging surface of such a runner, protects the wear resisting surfaces from fracturing and chipping, and which may be flexibly mounted to the vehicle.

It is an object of this invention to provide an improved vehicle mounted ancillary support equipment for use with street sweepers, snow plows, snow blowers and the like.

It is another object of this invention to provide an improved vehicle mounted ancillary support equipment for use with street sweepers, snow plows, snow blowers and the like which resists wear to the ground engaging surface of the support runner.

It is another object of this invention to provide an improved vehicle mounted ancillary support equipment for use with street sweepers, snow plows, snow blowers and the like which will more evenly distribute wear along the entire ground engaging surface of the support runner.

It is yet another object of this invention to provide an improved vehicle mounted ancillary support equipment for use with street sweepers, snow plows, snow blowers and the like having a flexible section for mounting the support runner to the vehicle.

It is still another object of this invention to provide an improved vehicle mounted ancillary support equipment for use with street sweepers, snow plows, snow blowers and the like having wear resistant metal inserts mounted in cavities through the ground engaging surface of the support runner to lengthen the useful work life of the support runner.

With these and other objects in view, which will become apparent to one skilled in the art as the description proceeds, this invention resides in the novel construction, combination and arrangement of parts substantially as hereinafter described, and more particularly defined by the appended claims, it being understood that changes in the precise embodiments of the herein disclosed invention are meant to be included as come within the scope of the claims.

BRIEF DESCRIPTION OF THE DRAWINGS

The accompanying drawings, together with the specification, illustrate complete embodiments of the invention according to the best mode so far devised for the practical application of the principles thereof and in which.

DESCRIPTION OF THE INVENTION

Figure 1:
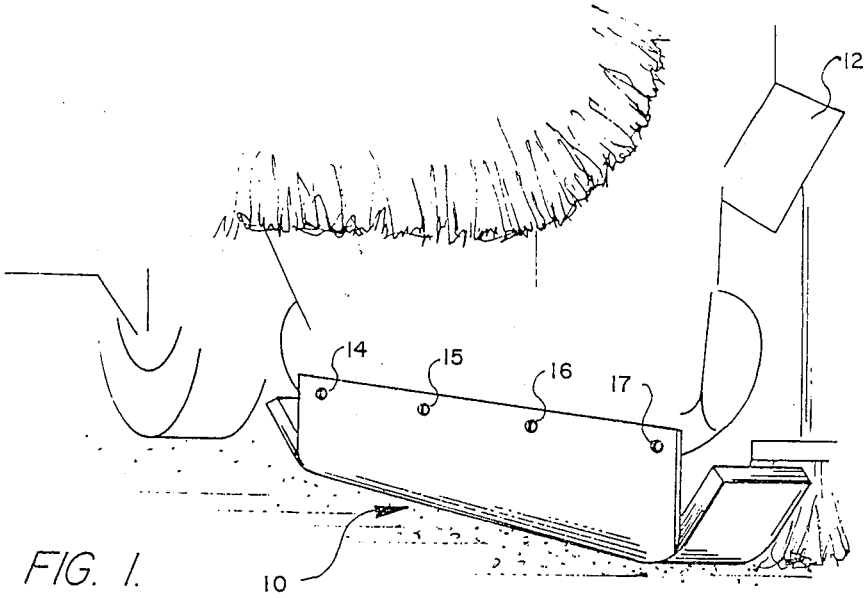
FIG. 1 is a perspective view of the support runner of this invention mounted to a street sweeper.

Referring now to the drawings, a wear shoe assembly 10 for use in association with street sweepers, plows, road graders and pavers and the like is shown in FIG. 1 in a surface engaged position mounted to the body of a street sweeper 12, by bolts 14, 15, 16 and 17, which are held in place by matching lockwashers and nuts (not shown).

Figure 2:
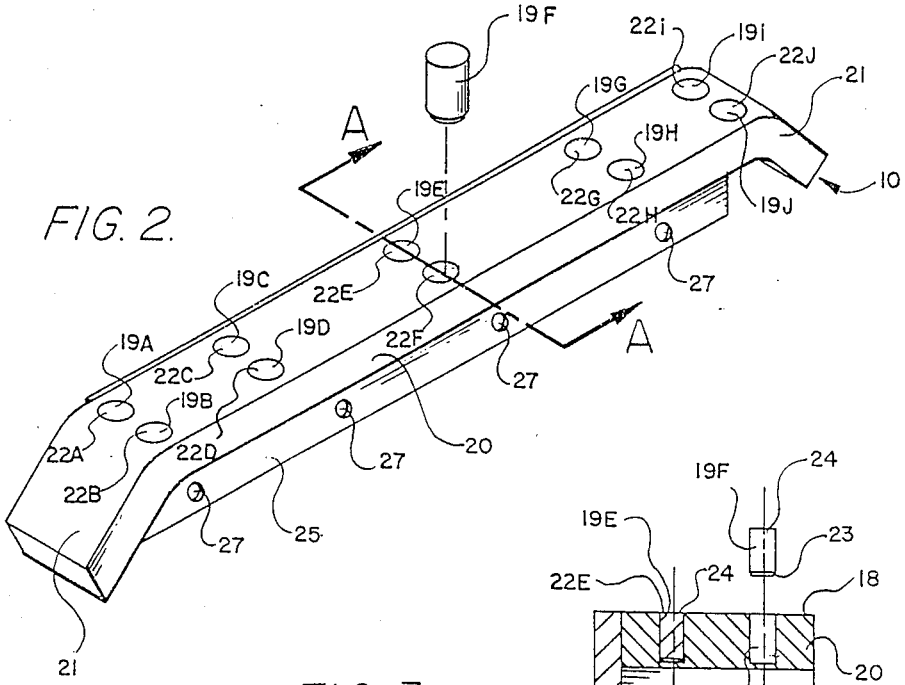
FIG. 2 is a perspective view of the support runner of this invention showing the ground engaging bottom surface thereof and the wear resistant metal inserts mounted therein.

FIG. 2 shows the surface contacting bottom portion 18 of wear shoe assembly 10, in which inserts 19A through 19J can be seen to reside within foot section 20. Inserts 19A–J are formed of a material having greater wear resistance than bottom portion 18, for example, any one of a number of the steel and carbide alloys available, and including products such as those employed by TRW Industrial Products Group for their Wendt-Sonis tungsten carbide drilling materials. Foot section 20 is a unitary solid body which may be made of steel plate, cast iron or other like materials, and has sloping end portions 21 which allow the surface contacting portion 18 of the wear shoe assembly to glide smoothly over surfaces without snagging.

Figure 3:
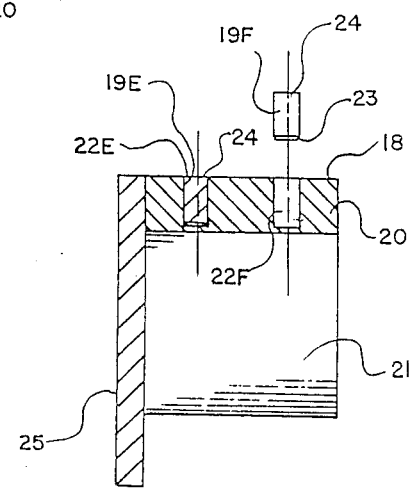
FIG. 3 is a cross-sectional view of the support runner of this invention taken along line A—A of FIG. 2 illustrating positioning of the wear resistant inserts within the runner.

Inserts 19A–J are elongate cylindrical inserts approximately ½" in diameter, which are pressed into the body of foot section 20 in matching cavities 22A through 22J. Cavities 22A–J are of a size just slightly smaller than the diameter of the inserts thereby maintaining the inserts by friction in foot section 20 without requiring soldering, brazing, adhesives or the like to keep them in place while also supporting the inserts against fracturing and chipping. As shown in FIG. 3, using inserts 19E and 19F as examples, the inserts have a beveled end portion 23 to facilitate mounting of the inserts within the cavities. The inserts and cavities (19E and 20E in FIG. 3 for example) are of matching length so that upper facets 24 of the inserts are substantially even with surface 18 after the inserts are mounted.

As shown in FIG. 2, runner attachment wall 25 extends upwardly from foot section 20, is attached, for example, by welding, and is provided with holes 27 for attachment to a vehicle, for example street sweeper 12 in FIG. 1.

Figure 4:
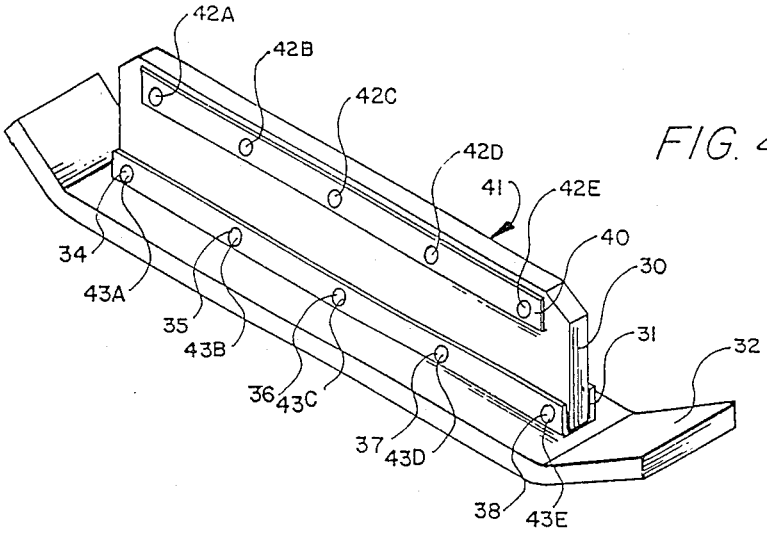
FIG. 4 is a perspective view of the now preferred embodiment of the support runner of this invention showing the top surface of the runner and having a flexible mounting means.

As shown in FIG. 4, an alternate embodiment of the attachment means (runner attachment wall 24 in FIG. 2) is shown. Here runner attachment wall 30 is attached to attachment wall mounting bracket 31 mounted on runner 32 by, for example, welding, by bolts and nuts 34 through 38. Runner attachment wall 30 is constructed of a flexible material, for example rubber or any of the number of heavy, flexible synthetic materials available. Runner attachment wall 30 is given added support by stiffening means 40 and 41 at the point of attachment to a vehicle, thereby avoiding any tearing of the flexible material forming runner attachment wall 30, or other wear which might cause runner attachment wall 30 to separate from the vehicle.

Holes 42A through 42E are positioned through stiffening means 40 and 41 and through attachment wall 30 to facilitate attachment to the vehicle. Bolts 34 through 38 are positioned in holes 43A through 43E of attachment wall 30 and mounting bracket 31, holes 43A–E being positioned such that, together with the placement of bracket 31 at the center of runner 32 rather than at one edge thereof, runner 32 may be turned or rotated periodically for still more even wear. By use of flexible attachment wall 30 the portion of the vehicle to which the runner is attached will suffer substantially no damage of the type currently caused to such vehicles by contact of the runner with curbs or other impediments.

By use of inserts (for exaqmple those shown in FIG. 2, 19A through 19J) with a greater wear resistance than the material typically employed for such a support runner, the useful life of the runner is greatly increased and that wear which does occur is spread more evenly over the entire bottom, surface contacting portion of the runner. By increasing the number and length of the cylindrical inserts, the wear life of a runner may be increased, or decreased depending on the desired useful lifetime of the runner, or the tool to which is it attached.

As can be appreciated from the foregoing, this invention provides an improved wear shoe, which provides longer more even wear of the wear shoe's surface contacting portion, decreasing the necessity of frequent repair or replacement, while supporting the inserts in such a way as to reduce the likelihood of fracturing and chipping of the inserts, and which may be constructed in a number of configurations for differing applications and employment with various tools, including snow plows, blowers, street sweepers, graders, pavers and the like.

What is claimed is:

1. A wear shoe for use with street sweepers, snow plows, snow blowers and the like, said wear shoe comprising:

a unitary runner having a ground engaging surface and an attachment portion, said runner having a plurality of cylindrical cavities therein, said cavities passing through said ground engaging surface;

a plurality of cylindrical wear resistant metal inserts maintained within said plurality of cavities such that each of said inserts substantially fills each of said cavities and said ground engaging surface is thereafter substantially without depressions or projections; and flexible attachment means for resiliently attaching said unitary runner to said street sweeper, snow plow, snow blower and the like, said flexible attachment means including a first attachment section attachable to said attachment portion of said unitary runner and a second attachment section attachable to said street sweeper, snow plow, snow blower and the like, said attachment portion of said unitary runner and said first attachment section of said flexible attachment means being detachable from one another, whereby said unitary runner may be reversed and reattached thereby reversing the wear patterns on said ground engaging surface.

2. The wear shoe of claim 1 wherein said plurality of inserts are made of tungsten carbide steel.

3. A device for supporting a utilization structure to be moved over a surface, said device comprising:

a foot section including a body portion one part of which is surface engagable and a second part of which includes attachment means; and flexible wall means having a first portion adapted to be attached to said utilization structure and a second portion adapted to be attached to said attachment means of said second part of said body portion of said foot section to thereby minimize potential damage to said utilization structure due to engagement of said surface engagable part of said body portion of said foot section with said surface, and said attachment means of said second part of said body portion of said foot section and said second portion of said flexible wall means being separable, said foot section thereby being reattachable to said flexible wall means in a reverse position so that wear patterns on said surface engagable part of said body portion of said foot section of said device are thereby reversed and evened.

4. The device of claim 3 wherein said attachment means of said second part of said body portion of said foot section includes channel means centrally attached to said second part of said body portion and configured to receive and retain said second portion of said flexible wall means.

5. The device of claim 3 wherein said flexible wall means includes reinforcement means adjacent said utilization structure to strengthen said first portion of said flexible wall means thereat.

6. The device of claim 3 wherein said flexible wall means is constructed substantially of one of rubber and flexible synthetic material.

7. An article for supporting an entity moving over a first surface, said article comprising:

a unitary runner having a second surface for contacting said first surface and a third surface facing oppositely said first surface having attachment means centrally mounted thereon, said unitary runner having a plurality of cavities therein, said cavities passing through said second surface;

a plurality of elongate inserts having a facet at one end thereof, said inserts maintained within said plurality of cavities substantially longitudinally perpendicular to both said first surface and said second surface so that substantially all of each one of said plurality of inserts resides within said unitary runner and only said facet is exposed to said first surface; and flexible wall means having a first attachment portion for attachment to said attachment means of said unitary runner and a second attachment portion for attachment to said entity, said attachment means of said unitary runner and said first attachment portion of said flexible wall means being separable, said unitary runner thereby being reattachable to said flexible wall means in a reversed position, whereby wear patterns on said second surface are thereby reversed and evened.

8. The article for supporting an entity moving over a first surface of claim 7 wherein said elongate inserts are more resistant to wear than said runner.

9. The article for supporting an entity moving over a first surface of claim 7 wherein said plurality of inserts are maintained within said plurality of cavities solely by compression fitting.

10. The article of claim 7 wherein said flexible wall means is a substantially rectangular sheet of one of rubber and flexible synthetic material receivable by said attachment means of said unitary runner at said first attachment portion thereof.

11. The article of claim 10 wherein said attachment means is a channel having opposite side walls and wherein said first attachment portion of said flexible wall means is received between said opposite side walls and attached therebetween.

12. The article of claim 10 wherein said flexible wall means includes reinforcement means at said second attachment portion thereof and adjacent said entity for preventing tearing of said flexible wall means at said attachment to said entity.

* * * * *